US010603710B2

(12) United States Patent
Leacock

(10) Patent No.: US 10,603,710 B2
(45) Date of Patent: Mar. 31, 2020

(54) RECONFIGURABLE METAL FORMING APPARATUS

(71) Applicant: University of Ulster, Coleraine, County Londonderry (GB)

(72) Inventor: Alan Leacock, Carrickfergus (GB)

(73) Assignee: University of Ulster, Coleraine, County Londonderry (GB)

( * ) Notice: Subject to any disclaimer, the term of this patent is extended or adjusted under 35 U.S.C. 154(b) by 755 days.

(21) Appl. No.: 15/115,139

(22) PCT Filed: Jan. 27, 2015

(86) PCT No.: PCT/EP2015/051565
§ 371 (c)(1),
(2) Date: Jul. 28, 2016

(87) PCT Pub. No.: WO2015/113954
PCT Pub. Date: Aug. 6, 2015

(65) Prior Publication Data

US 2016/0354829 A1 Dec. 8, 2016

(30) Foreign Application Priority Data

Jan. 29, 2014 (GB) ..... 1401474.0

(51) Int. Cl.
*B21D 25/02* (2006.01)
*B21D 37/02* (2006.01)
*B21D 25/04* (2006.01)

(52) U.S. Cl.
CPC ..... *B21D 25/02* (2013.01); *B21D 25/04* (2013.01); *B21D 37/02* (2013.01)

(58) Field of Classification Search
CPC ..... B21D 25/02; B21D 25/04; B21D 37/02; B21D 11/02; B21D 11/20; B21D 22/06
See application file for complete search history.

(56) References Cited

U.S. PATENT DOCUMENTS 3,172,453 A * 3/1965 Lauper ..... B21D 37/02 72/212
4,212,188 A * 7/1980 Pinson ..... B21D 11/20 72/413

(Continued)

FOREIGN PATENT DOCUMENTS

CN 102205366 10/2011
DE 607377 12/1934

(Continued)

OTHER PUBLICATIONS

International Search Report and Written Opinion of corresponding PCT Application No. PCT/EP2015/051565, dated Jun. 9, 2015.

*Primary Examiner* — Teresa M Ekiert
(74) *Attorney, Agent, or Firm* — Gardner, Linn, Burkhart & Ondersma LLP

(57) ABSTRACT

A reconfigurable stretch forming apparatus includes an array of pins adapted to be individually adjustable in height to define a reconfigurable forming surface, a pair of counter-rotating workpiece gripping devices being provided on opposite sides of the array of pins, each gripping device having an arcuate support surface for supporting a workpiece and a clamp member for clamping a work piece against the arcuate support surface, a driver being provided for rotating the counter-rotating gripping devices in opposing directions to stretch the work piece over the forming surface.

19 Claims, 10 Drawing Sheets

(56) References Cited

U.S. PATENT DOCUMENTS

| | | | | |
|---|---|---|---|---|
| 5,954,175 | A * | 9/1999 | Haas | B21D 37/02 192/48.2 |
| 6,053,026 | A | 4/2000 | Nardiello et al. | |
| 6,298,896 | B1 * | 10/2001 | Sherrill | B29C 33/0011 156/581 |
| 2012/0291512 | A1 | 11/2012 | Kang et al. | |
| 2018/0311718 | A1 | 11/2018 | Leacock | |

FOREIGN PATENT DOCUMENTS

| | | |
|---|---|---|
| WO | WO2007085041 | 8/2007 |
| WO | 2009/145538 | 12/2009 |

* cited by examiner

RECONFIGURABLE METAL FORMING APPARATUS

CROSS REFERENCE TO RELATED APPLICATIONS

The present application is a § 371 national stage of International Application PCT/EP2015/051565, filed Jan. 27, 2015, which claims the priority benefit of U.K. patent application Ser. No. 1401474.0, filed Jan. 29, 2014, both of which are hereby incorporated herein by reference in their entireties.

FIELD OF THE INVENTION

This invention relates to a reconfigurable metal forming apparatus.

BACKGROUND OF THE INVENTION

The production of low volume sheet metal components is a difficult balancing act of non-recurrent equipment cost and final component sale value. Industry sectors in which low volume components are commonplace include aerospace, marine and architecture. Each of these industry sectors presents unique challenges that are a combination of the component material, tolerances required and number of repeat components. While Aerospace utilises high strength metals that must meet stringent dimensional tolerances manufactured in reasonable batch numbers, architecture typically employs comparatively lower strength metals with wider dimensional tolerances and often single component manufacture.

Traditional manufacturing methods employed in the production of components for these industry sectors often utilise fixed tools and large complex machines that require substantial foundations. Tooling costs can be reduced through the use of processes such as stretch forming where, depending upon the component shape, only a single male tool is required. Costs can be further reduced through the reuse of tooling by machining the tool multiple times. Nevertheless, such innovations are limited in the achievable cost savings.

One possible alternative is reconfigurable pin tool technology, where a forming surface is defined by an array of height adjustable pins, typically having a flexible interpolator sheet located between the pins and the work piece, wherein the heights of the pins can be adjusted to vary the shape of the forming surface. The use of reconfigurable pin tool technology in stretch forming has been the subject of much research over the past 20 years. However, most prior art attempts to exploit this technology have resulted in complex and expensive incarnations that, while technically brilliant, have been commercially flawed. In addition, the use of complex stretch forming machines to stretch a sheet metal blank over the forming surface have further increased the overall production cost and have therefore limited the adoption of reconfigurable pin tool technology.

SUMMARY OF THE INVENTION

The present invention provides a relatively low cost and highly adaptable reconfigurable metal forming apparatus. According to a first aspect of the present invention there is provided a reconfigurable stretch forming apparatus having an array of pins adapted to be individually adjustable in height to define a reconfigurable forming surface, a pair of counter-rotating workpiece gripping devices being provided on opposite sides of the array of pins, each gripping device having an arcuate support surface for supporting a workpiece and a clamp member for clamping a work piece against the arcuate support surface, a driver or drive means being provided for rotating the counter-rotating gripping devices in opposing directions to stretch the work piece over the forming surface.

Optionally, each of the gripping devices includes a roller, an outer surface of the roller defining the arcuate support surface of the respective gripping device.

In another embodiment the clamp member of each gripping device includes an eccentrically mounted cam or roller mounted adjacent the arcuate support surface of the respective gripping device, an outer surface of the clamp member defining a clamping surface acting against the arcuate support surface to clamp a workpiece thereagainst, wherein the clamp member is rotatable between a first position, wherein the clamping surface of the clamp member is spaced from the arcuate support surface, and a second position, wherein the clamping surface of the clamp member engages the arcuate support surface. The clamp member of each gripping device may be eccentrically rotatable about an axis extending parallel to a rotation axis of the respective gripping device. Optionally, the arcuate support surface of each gripping device is located between a respective pair of end plates, the respective clamp member being mounted between the end plates for rotation between its first and second positions. The direction of rotation of the clamp member of each gripping device between its first and second positions may be arranged such that the respective clamp member is biased towards its second position under the action of the workpiece during a stretch forming operation.

The clamp member of each gripping device may be provided with an operating lever extending substantially radially therefrom for rotating the respective clamp member between its first and second positions. A portion of the operating lever of each clamp member may be adapted to abut the respective arcuate support surface when the clamp member is in its second position.

Optionally, the array of pins defines an arcuate forming surface extending between the gripping devices.

Optionally, an end cap is mounted on an upper end of each pin. Each end cap may be articulated with respect to the pin upon which the end cap is mounted to permit tilting of the end cap with respect to the pin. The diameter of each end cap may be smaller than the diameter of the pin upon which it is mounted. Each end cap may be mounted on a respective pin via a ball and socket coupling.

The gripping devices may be linked via one or more linkage means, such as gears and/or rigid or flexible linkages, such as chains, to ensure that they both rotate by equal amounts when the drive means is operated to ensure even stretching of the blank over the forming surface. In one embodiment the linkage means may include one or more chains extending between and around the counter-rotating gripping devices to constrain the gripping devices to rotate in opposite directions and by equal amounts.

Optionally, the drive means includes one or more linear actuators acting between the gripping devices to urge the gripping devices to rotate in opposite direction when the one or more actuators are extended. The gripping devices may be supported between a pair of side plates of a base, the actuators extending substantially parallel to the side plates.

In one embodiment each pin may include an upper part and a base part, the upper and base parts being threadedly engaged with one another such the height of the pin can be adjusted by rotation of the upper part with respect to the base part. The base part of each pin may include a threaded rod or stud upon which the upper part is threadedly engaged.

The underside of the end cap of each pin may be adapted to engage a portion of the upper part of the respective pin to prevent rotation of the end cap with respect to the pin when the end cap is tilted to an adjustment position with respect to the pin, such that a turning torque can be applied to the pin via the end cap by means of a suitable tool adapted to engage the end cap when in the adjustment position. In one embodiment the underside of the end cap may be shaped to engage a face of a nut located on the upper part of the pin beneath the end cap when the cap is in the adjustment position.

The array of pins may be mounted on a common support, the support and/or the rollers being displaceable vertically with respect to a common base, whereby the forming surface and the roller can be vertically displaced with respect to one another during a stretch forming process.

An interpolator sheet may be mounted on top of the array of pins to define the reconfigurable forming surface.

According to a further aspect of the present invention there is provided a reconfigurable support surface for supporting a blank or workpiece, the support surface being defined by an array of pins, each pin includes an upper part and a base part, the upper and base parts being threadedly engaged with one another such the height of each pin can be adjusted by rotation of the upper part with respect to the base part thereof, an end cap being mounted on an upper end of each pin, wherein each end cap is articulated with respect to the pin upon which the end cap is mounted to permit tilting of the end cap with respect to the pin, wherein the underside of the end cap of each pin is adapted to engage a portion of the upper part of the respective pin to prevent rotation of the cap with respect to the pin when the cap is tilted to an adjustment position with respect to the pin, such that a turning torque can be applied to the pin via the cap by means of a suitable tool adapted to engage the cap when in the adjustment position.

Each end cap may be mounted on a respective pin via a ball and socket coupling.

In one embodiment the base part of each pin includes a threaded rod or stud upon which the upper part is threadedly engaged.

In one embodiment the underside of the end cap of each pin shaped to engage a face of a nut located on the upper part of the pin beneath the end cap when the end cap is in the adjustment position.

The support surface may be a forming surface of a metal forming apparatus or a support surface for supporting a workpiece during a machining process.

These and other objects, advantages and features of the invention will become apparent upon review of the following specification in conjunction with the drawings.

BRIEF DESCRIPTION OF THE DRAWINGS

A reconfigurable metal forming apparatus in accordance with an embodiment of the present invention will now be described, by way of example only, with reference to the accompanying drawings, in which.

DETAILED DESCRIPTION OF THE PREFERRED EMBODIMENTS

Figure 1:
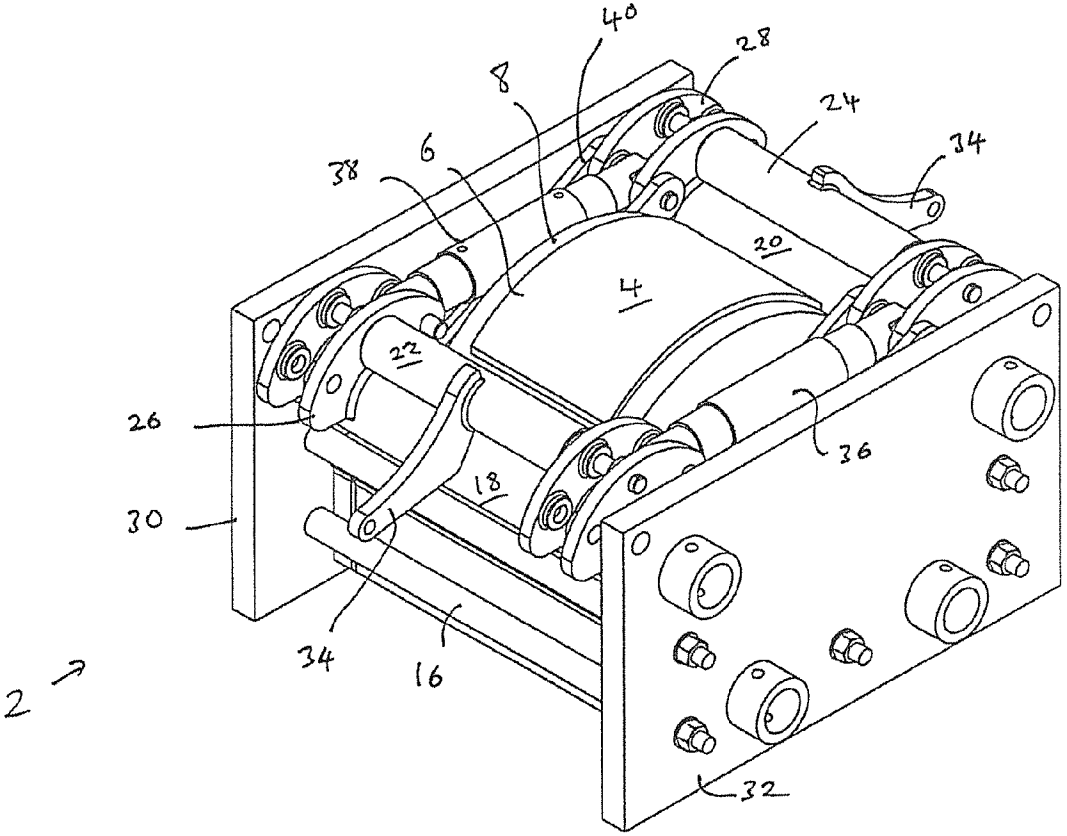
FIG. 1 is a perspective view of a metal forming apparatus in accordance with an embodiment of the present invention.

As illustrated in the drawings, a reconfigurable stretch forming apparatus 2 in accordance with an embodiment of the present invention includes an arcuate reconfigurable forming surface 4 defined by a flexible interpolator (flexible covering sheet) 6 located on top of a pin array 8, each pin 10 of the array 8 being individually adjustable in height to alter the shape of the forming surface 4.

Figure 6:
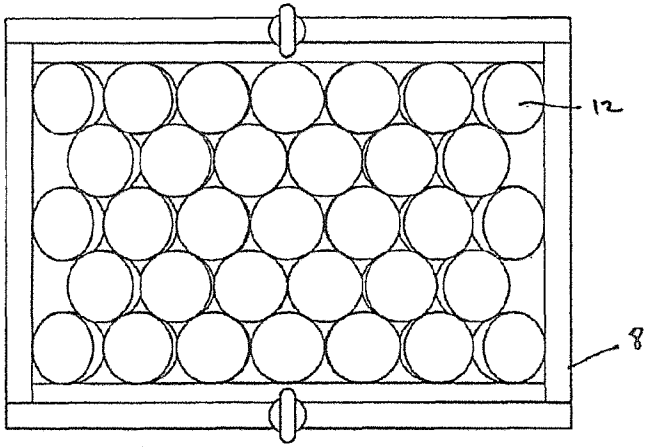
FIG. 6 is a plan view of a pin array of the apparatus of FIG. 1.
Figure 7:
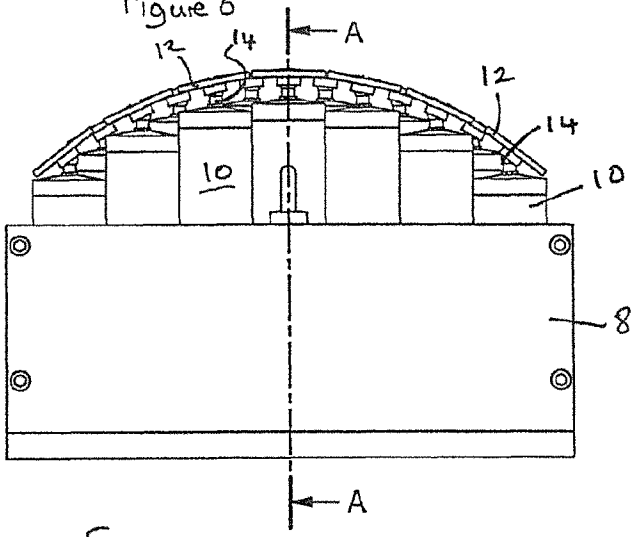
FIG. 7 is an end view of the pin array of FIG. 6.
Figure 8:
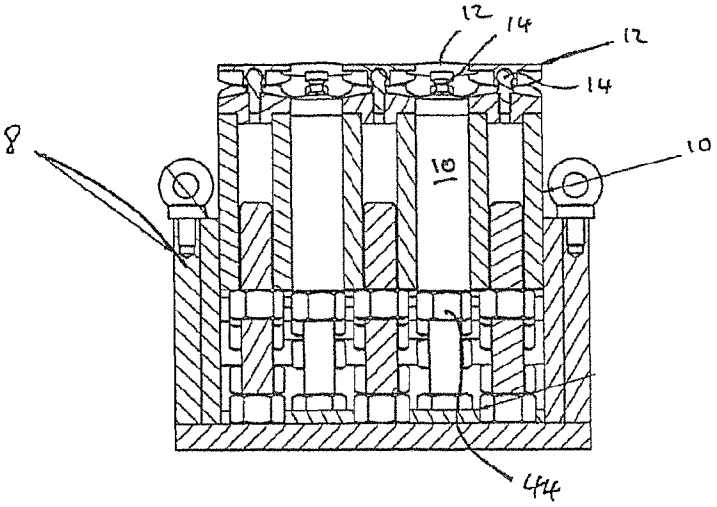
FIG. 8 is a sectional view of the pin array on line A-A of FIG. 7.

As best shown in shown FIGS. 6 to 8, the pins 10 of the pin array 8 are arranged in a hexagonal close packed pattern. Each pin 10 has a circular end cap 12 mounted on an upper end thereof via a ball and socket articulated joint 14, wherein the end cap 12 can tilt with respect to the pin 10 upon which it is mounted. The articulated end caps 12 are define a substantially continuous and stepless surface, minimising the surface indentation from the discrete nature of the tool. As a result, the interpolator 6 between the pins 10 and the formed sheet (workpiece) can be significantly thinner than prior art interpolators and can possibly be omitted.

The pin array 8 is mounted on a base frame 16 between a pair of workpiece gripping devices, each including a workpiece support roller 18,20 having an outer surface defining an arcuate workpiece support surface, against which a respective end of the workpiece is clamped by means of an eccentrically mounted clamping roller 22,24 mounted parallel to the respective support roller 18,20 between a pair of mounting plates 26,28 provided at either end of each support roller 18,20.

Figure 2:
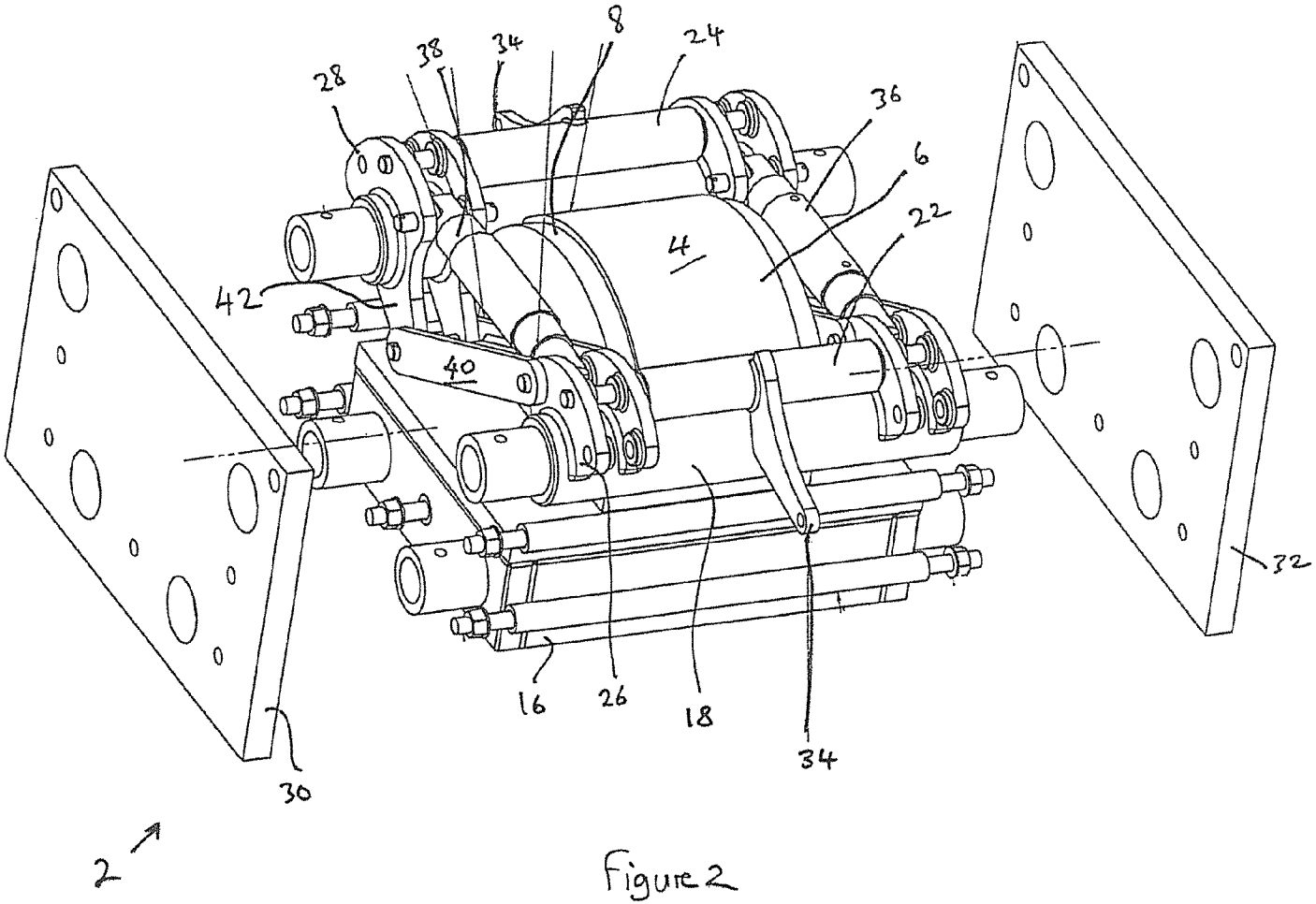
FIG. 2 is a partially exploded view of the apparatus of FIG. 1.
Figure 3:
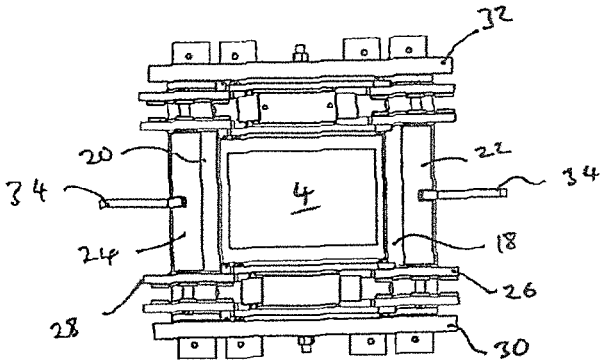
FIG. 3 is a plan view of the apparatus of FIG. 1.
Figure 4:
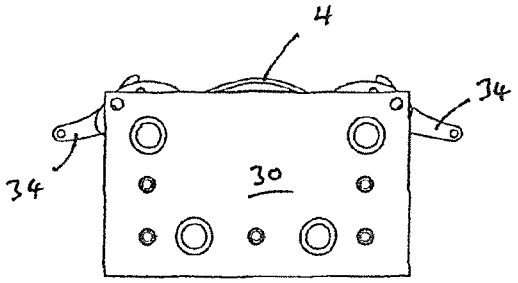
FIG. 4 is an end view of the apparatus of FIG. 1.

The support rollers 18,20 are mounted between opposing side plates 30,32 of the base frame 16 of the apparatus, as best seen from FIGS. 1 and 2.

Figure 5:
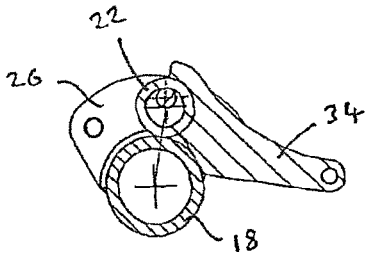
FIG. 5 is a detailed view of a gripping device of the apparatus of FIG. 1.

As best shown from FIG. 5, each clamping roller 22,24 is mounted eccentrically between the mounting plates 26,28 of the respective support roller 18,20 such that the clamping roller 22,24 can be rotated between a first position, wherein the outer surface of the clamping roller 22,24 is spaced from the outer surface of the support roller 18,20, and a second position (shown in FIG. 5), wherein the outer surface of the clamping roller 22,24 engages the outer surface of the support roller 18,20.

An operating lever 34 extends substantially radially from each clamping roller 22,24 for moving the respective clamping roller between its first and second positions. As shown in FIG. 5, each operating lever 34 is shaped to abut the outer surface of the adjacent support roller 18,20 when the respective clamping roller 22,24 is in its second position. The direction of rotation of each clamping roller 22,24 between its respective first and second positions is arranged such that a biasing force acting against the clamping roller 18,20 by means of a workpiece clamped between the clamping roller and the adjacent support roller during a stretch forming operation urges the clamping roller towards its second position, increasing the clamping force applied to the workpiece by the clamping roller. The operating levers 34 may be manipulated manually or may be connected to suitable actuators, such as double acting hydraulic rams or suitable electric motors.

While clamping rollers 22,24 are described as being provided for clamping a workpiece against the support rollers 18,20, it is envisaged that other clamping means or device may be used for clamping the blank against the support rollers, such as eccentrically mounted cams or curved surfaces instead of cylindrical clamping rollers.

A pair of linear actuators 36,38, preferably rams, typically hydraulic or pneumatic double acting rams, are mounted on either side of the pin array 8, to rotate the support rollers 18,20, the actuators 36,38 engaging the mounting plates 26,28 of the support rollers 18,20 such that extension of the actuators 36,38 causes the support rollers 18,20 to rotate in opposite directions, stretching a workpiece over the forming surface 4, as will be described in more detail below.

Figure 9:
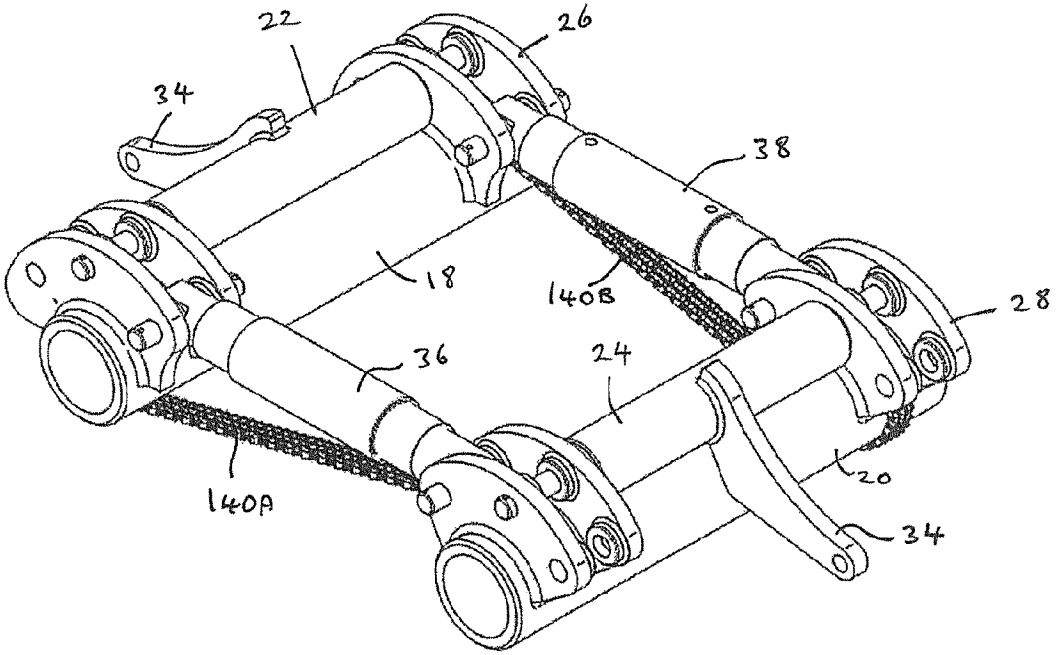
FIG. 9 is a perspective view of the support roller assembly of a metal forming apparatus in accordance with a further embodiment of the present invention.
Figure 10:
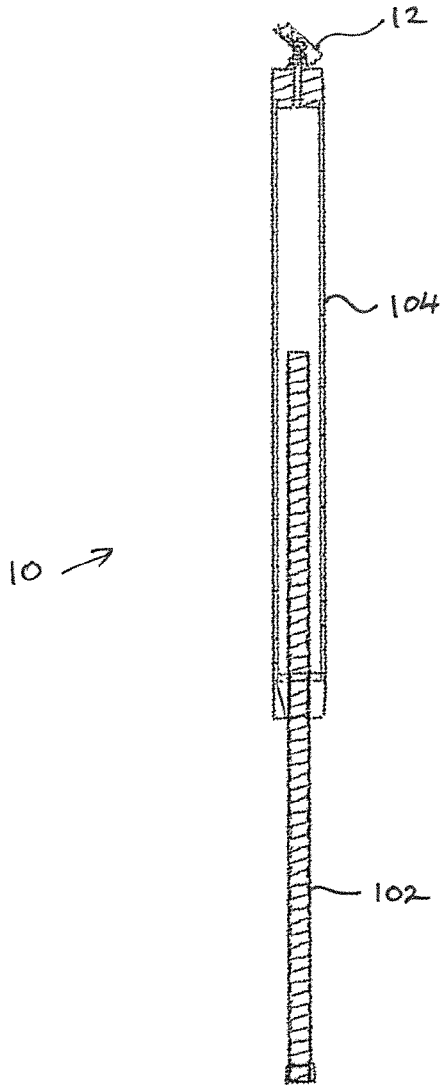
FIG. 10 is a sectional view through a pin of a metal forming tool in accordance with a further embodiment of the present invention.

As best illustrated in FIG. 2, pivotally mounted rigid link arms 40 extend between the mounting plates 26,28 of the support rollers 18,20, extending between an upper side of one support roller 18 and a lower extension arm 42 of the mounting plates 28 of the other support roller 20, such that the support rollers 18,20 are constrained to rotate by equal amounts as the actuators 36,38 are extended and retracted. It is envisaged that the support rollers 18,20 may be interlinked by other means, such as chains or gearing, to ensure that the support rollers rotate by equal amounts and in opposite direction to one another. For example, in the embodiment shown in FIG. 9, the support rollers 18,20 are linked by chains 140A,140B that are attached to each support roller 18,20 at either end and are arranged to wind around and unwind from the support rollers 18,20 as they rotate to ensure that the support rollers are constrained for counter rotation by equal amounts. The counter rotating support rollers 18,20 are adapted to wind a workpiece around the arcuate forming surface 4, and hence stretch the material.

In one embodiment, the pin array 8 may be mounted upon the base frame 16 via suitable actuators (not shown) so that the pin array 8 may be raised with respect to the base during a stretch forming operation.

In use, a workpiece, typically a sheet of metal, such as aluminium or steel, is mounted on the apparatus, with opposite ends of the sheet passing between the support rollers 18,20 and clamping rollers 22,24 of the workpiece gripping devices, with the workpiece lying over the forming surface.

Before, or after locating the workpiece onto the apparatus, each pin 10 of the pin array 8 may be adjusted in height such that the forming surface has the desired three dimensional shape. The position of the pins 10 may be manually adjusted, for example via threaded adjusters (44, FIG. 8), or may be adjusted by drive means, such as stepper motors or hydraulic actuators. The required position of the pins 10 may be determined by computer software.

In the embodiment shown in FIGS. 10 to 17 the height of each pin 10 (or of groups of pins) in the array of pins may be adjusted by means of an adjusting tool adapted to engage with the end cap 12 of each pin 10, as will be described in more detail below.

In such embodiment, each pin 10 of the array includes a lower part 102 defined by a vertically extending threaded rod, and an upper part 104 threadedly engaged onto the lower part 102 such that rotation of the upper part 104 with respect to the lower part 102 of the pin 10 varies the height of the pin 10. As with the first embodiment, an end cap 12 is mounted on an upper end of the upper part 104 of the pin 10 via a ball and socket articulated joint 14, wherein the end cap 12 can tilt with respect to the pin 10 upon which it is mounted such that the upper faces of the end caps 12 can define a substantially smooth continuous surface, thus minimising the surface indentation from the discrete nature of the tool.

In the embodiment shown in FIGS. 10 to 17, the underside of the end cap 12 incorporates a "V" shaped circumferential ridge 106 having an inner face 108 adapted to engage a portion of the upper part 104 of the pin 10 when the end cap 12 is tilted beyond a normal operating angle to a pin adjustment position, in which position the engagement of the face 108 of the end cap 10 with the upper part 104 of the pin 10 prevents rotation of the end cap 12 with respect to the pin 10 and enables the end cap 12 to be engaged by an adjustment tool, whereby the end cap 12 and upper part 104 of the pin 10 can be rotated by the tool to facilitate adjustment of the height of the pin 10.

Figure 11:
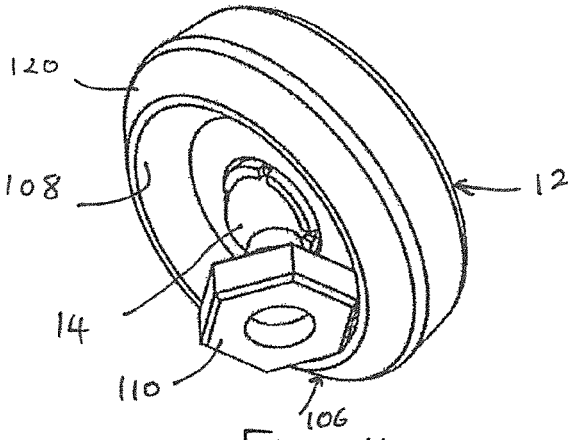
FIG. 11 is a detailed perspective view of the head of the pin of FIG. 10.
Figure 12:
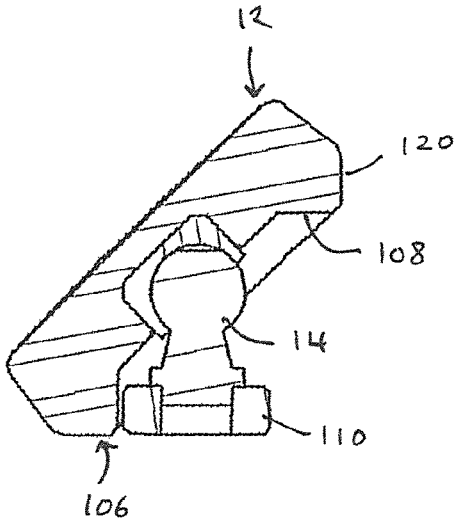
FIG. 12 is a sectional view through the pin of FIG. 10.

In the embodiment shown in FIGS. 10 to 17, as best seen from FIGS. 11 and 12, a nut 110 is mounted beneath the ball and socket joint 14 of the end cap 12, the engagement face 108 of the end cap 12 being arranged to abut a face of the nut 110 when the end cap 12 is tilted to the adjustment position. However, it is envisaged that other cooperating formations could formed on the pin 10 and the end cap 12 adapted to engage on another when the end cap 12 is tilted to the adjustment position.

Figure 13:
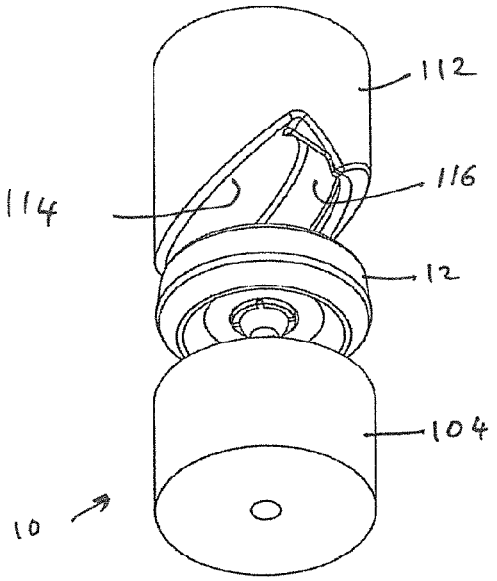
FIG. 13 is a sectional view of the head of the pin of FIG. 10 and a tool for adjusting the height of the pin.
Figure 14:
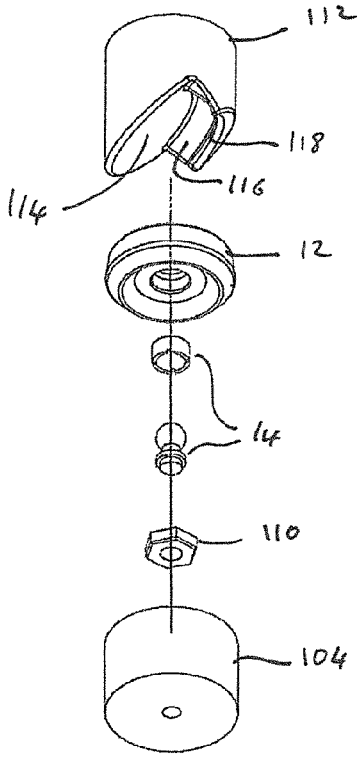
FIG. 14 is an exploded view of the head of the pin of FIG. 10.
Figure 15:
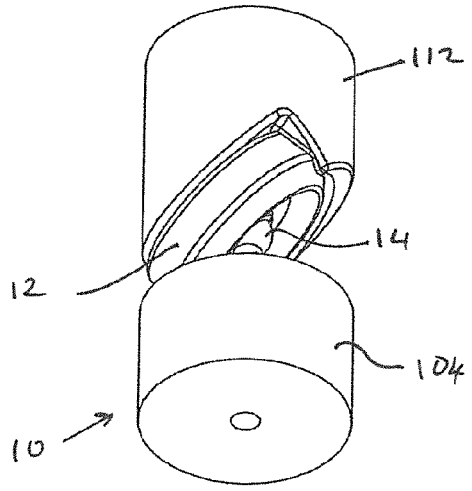
FIG. 15 perspective view showing the interaction of the tool with the head of the pin of FIG. 10.
Figure 16:
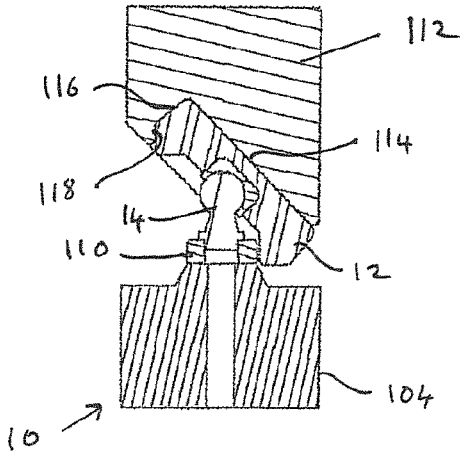
FIG. 16 is a longitudinal sectional view showing the interaction of the tool with the head of the pin of FIG. 10.

An adjustment tool for adjusting the height of each pin 10 includes an adjustment head 112 adapted to engage the end cap 12 of a respective pin 10 when the end cap is in its adjustment position. As best shown in FIGS. 13 and 14, the adjustment head 112 includes a first angled face 114 adapted to engage an upper face of the end cap 12, a curved side face 116 adapted to engage an outer side of the end cap 12 and a lip 118 adapted to engage an outer face 120 of the ridge 106 defined on the underside of the end cap 12. As illustrated in FIGS. 15 and 16, the shape of the adjustment head 12 of the adjustment tool is adapted to fit closely against and engage the end cap 12 of a respective pin such that the adjustment head 112 can drive the end cap 12 to rotate about the longitudinal axis of the respective pin 10, the end cap 12 in turn transmitting this rotation to the upper part 104 of the respective pin 10 such that the upper part 104 of the pin 10 can be rotated with respect to the lower part 102 thereof to adjust the height of the pin 10.

Figure 17:
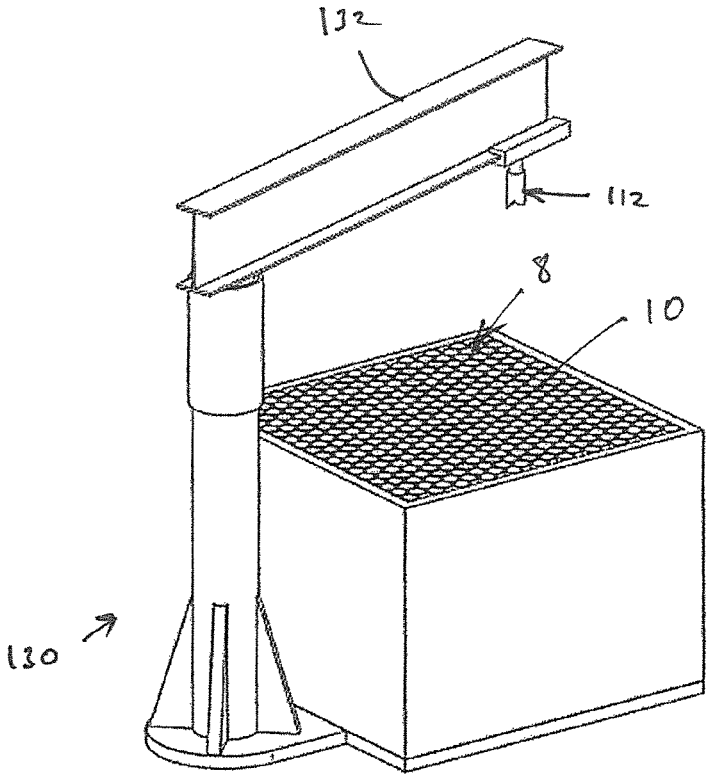
FIG. 17 is a perspective view of an assembly for adjusting the height of the pins to alter the shape of the forming surface.

FIG. 17 illustrates an adjustment tool 130 in accordance with an embodiment of the present invention, wherein the adjustment head 112 is mounted on a gantry 132 mounted over the pin array 8, wherein the adjustment head 112 can be positioned over each pin 10 and raised and lowered to engage the end cap 12 of a respective pin 10, the adjustment head 112 being rotatably driven to enable the height of each pin 10 to be adjusted to a desired height.

In an alternative embodiment (not shown) it is envisaged that the adjustment tool may be provided with an array of adjustment heads, for example seven heads arranged in a hexagonal formation, to facilitate simultaneous adjustment of respective groups of pins to facilitate faster adjustment of the forming surface. Once a workpiece has been located onto the apparatus, the operating levers 34 are manipulated to move the clamping rollers 22,24 towards their second positions, clamping the workpiece between the clamping rollers 22,24 and the respective support rollers 18,20.

The actuators 36,38 are then extended to cause the support rollers 18,20 to rotate in opposite directions, stretching the workpiece over the forming surface 4 to stretch the material into the desired shape. At the same time the pin array 8 may be raised with respect to the base frame 16. It is also envisaged that individual pins 10 may be raised or lowered during a stretch forming operation.

The mounting of the support rollers 18,20 and the actuators 36,38 between the side plates 30,32 of the base frame 16 enables all loads to be reacted through the base frame 16 and actuators 36,38, eliminating the need for expensive and time consuming installation of the apparatus. The increased flexibility from this design increases the number of possible customers who can adopt the new system.

The dimensions of the apparatus may be selected depending upon the desired maximum size of article to be produced. It is envisaged that the dimensions of the apparatus may be selected such that the apparatus can be fitted into a standard shipping container, with no or limited disassembly.

The apparatus may include a controller which may be linked to a computer. Data may be transferred between the computer and controller wirelessly or via a wired connection. The computer may be at a location remote from the controller and data may be transferred between the computer and the controller via the Internet. Hence the user of the forming apparatus may not require any knowledge of the metal forming process, making it possible for the apparatus to be used to manufacture articles by those unskilled in the art, with the forming process being programmed and/or controlled remotely.

The invention is not limited to the embodiment(s) described herein but can be amended or modified without departing from the scope of the present invention, which is intended to be limited only by the scope of the appended claims as interpreted according to the principles of patent law including the doctrine of equivalents.

The invention claimed is:

1. A reconfigurable stretch forming apparatus comprising:

an array of pins adapted to be individually adjustable in height to define a reconfigurable forming surface;

a pair of counter-rotating workpiece gripping devices being provided on opposite sides of the array of pins, each gripping device comprising a roller having an outer surface that defines an arcuate support surface for supporting a workpiece and a clamp member;

the clamp member of each gripping device comprising an eccentrically mounted cam or roller mounted adjacent the arcuate support surface of the respective gripping device, an outer surface of the clamp member defining a clamping surface acting against the arcuate support surface to clamp the workpiece thereagainst;

wherein each clamp member is rotatable between a first position in which the clamping surface of the clamp member is spaced from the respective arcuate support surface, and a second position in which the clamping surface of the clamp member engages the respective arcuate support surface;

the clamp member of each gripping device being eccentrically rotatable about an axis extending parallel to a rotation axis of the respective gripping device, and comprising a driver operable to rotate the counter-rotating gripping devices in opposing directions to stretch the work piece over the forming surface; and wherein the driver of the clamp member of each gripping device includes an operating lever extending substantially radially from the respective clamp member for rotating the respective clamp member between its first and second positions.

2. An apparatus as claimed in claim 1, wherein the arcuate support surface of each gripping device is located between a respective pair of end plates, the respective clamp member being mounted between the end plates for rotation between its first and second positions.

3. An apparatus as claimed in claim 1, wherein the direction of rotation of the clamp member of each gripping device between its first and second positions is such that the respective clamp member is biased towards its second position under the action of the workpiece during a stretch forming operation.

4. An apparatus as claimed in claim 1, wherein a portion of the operating lever of each clamp member is adapted to abut the respective arcuate support surface when the clamp member is in its second position.

5. An apparatus as claimed in claim 1, wherein an end cap is mounted on an upper end of each pin.

6. An apparatus as claimed in claim 5, wherein each end cap is articulated with respect to the pin upon which the end cap is mounted to permit tilting of the end cap with respect to the pin.

7. An apparatus as claimed in claim 6, wherein the diameter of each end cap is smaller than the diameter of the pin upon which it is mounted.

8. An apparatus as claimed in claim 5, wherein each end cap is mounted on a respective pin via a ball and socket coupling.

9. An apparatus as claimed in claim 8, wherein each pin comprises an upper part and a base part, the upper and base parts being threadedly engaged with one another such that the height of the pin can be adjusted by rotation of the upper part with respect to the base part.

10. An apparatus as claimed in claim 9, wherein the base part of each pin comprises a threaded rod or stud upon which the upper part is threadedly engaged.

11. An apparatus as claimed in claim 9, wherein the underside of the end cap of each pin is adapted to engage a portion of the upper part of the respective pin to prevent rotation of the end cap with respect to the pin when the end cap is tilted to an adjustment position with respect to the pin, such that a turning torque can be applied to the pin via the end cap when in the adjustment position.

12. An apparatus as claimed in claim 11, wherein the underside of the end cap is shaped to engage a face of a nut located on the upper part of the pin beneath the end cap when the cap is in the adjustment position.

13. An apparatus as claimed claim 1, wherein the gripping devices are linked via at least one linkage to ensure that they both rotate by equal amounts when the driver is operated to ensure even stretching of the blank over the forming surface.

14. An apparatus as claimed in claim 13, wherein the at least one linkage comprises one or more chains extending between and wrapping around the counter-rotating gripping devices to constrain the gripping devices to rotate in opposite directions by equal amounts.

15. An apparatus as claimed in claim 1, wherein the driver comprises one or more linear actuators acting between the gripping devices to urge the gripping devices to rotate in opposite directions when the one or more actuators are extended.

16. An apparatus as claimed in claim 15, wherein the gripping devices are supported between a pair of side plates of a base, the one or more actuators extending substantially parallel to the side plates.

17. An apparatus as claimed in claim 1, wherein an interpolator sheet is mounted on top of the array of pins to define the reconfigurable forming surface.

18. A reconfigurable stretch forming apparatus comprising:

an array of pins adapted to be individually adjustable in height to define a reconfigurable forming surface;

a pair of counter-rotating workpiece gripping devices being provided on opposite sides of the array of pins, each gripping device comprising a roller having an outer surface that defines an arcuate support surface for supporting a workpiece and a clamp member;

the clamp member of each gripping device comprising an eccentrically mounted cam or roller mounted adjacent the arcuate support surface of the respective gripping device, an outer surface of the clamp member defining a clamping surface acting against the arcuate support surface to clamp the workpiece thereagainst;

wherein each clamp member is rotatable between a first position in which the clamping surface of the clamp member is spaced from the respective arcuate support surface, and a second position in which the clamping surface of the clamp member engages the respective arcuate support surface;

the clamp member of each gripping device being eccentrically rotatable about an axis extending parallel to a rotation axis of the respective gripping device, and comprising a driver operable to rotate the counter-rotating gripping devices in opposing directions to stretch the work piece over the forming surface;

wherein the gripping devices are linked via at least one linkage to ensure that they both rotate by equal amounts when the driver is operated to ensure even stretching of the blank over the forming surface; and wherein the at least one linkage comprises one or more chains extending between and wrapping around the counter-rotating gripping devices to constrain the gripping devices to rotate in opposite directions by equal amounts.

19. A reconfigurable stretch forming apparatus comprising:

an array of pins adapted to be individually adjustable in height to define a reconfigurable forming surface;

a pair of counter-rotating workpiece gripping devices being provided on opposite sides of the array of pins, each gripping device comprising a roller having an outer surface that defines an arcuate support surface for supporting a workpiece and a clamp member;

the clamp member of each gripping device comprising an eccentrically mounted cam or roller mounted adjacent the arcuate support surface of the respective gripping device, an outer surface of the clamp member defining a clamping surface acting against the arcuate support surface to clamp the workpiece thereagainst;

wherein each clamp member is rotatable between a first position in which the clamping surface of the clamp member is spaced from the respective arcuate support surface, and a second position in which the clamping surface of the clamp member engages the respective arcuate support surface;

the clamp member of each gripping device being eccentrically rotatable about an axis extending parallel to a rotation axis of the respective gripping device, and comprising a driver operable to rotate the counter-rotating gripping devices in opposing directions to stretch the work piece over the forming surface;

wherein the driver comprises one or more linear actuators acting between the gripping devices to urge the gripping devices to rotate in opposite direction when the one or more actuators are extended; and wherein the gripping devices are supported between a pair of side plates of a base, the one or more actuators extending substantially parallel to the side plates.

* * * * *